US007794028B2

(12) United States Patent
Brunnmayr

(10) Patent No.: US 7,794,028 B2
(45) Date of Patent: Sep. 14, 2010

(54) CUPBOARD-STYLE FURNITURE ITEM

(75) Inventor: Harald Brunnmayr, Hörbranz (AT)

(73) Assignee: Julius Blum GmbH, Höchst (AT)

( * ) Notice: Subject to any disclaimer, the term of this patent is extended or adjusted under 35 U.S.C. 154(b) by 0 days.

(21) Appl. No.: 11/976,756

(22) Filed: Oct. 26, 2007

(65) Prior Publication Data

US 2008/0054771 A1 Mar. 6, 2008

Related U.S. Application Data

(63) Continuation of application No. PCT/AT2006/000152, filed on Apr. 14, 2006.

(30) Foreign Application Priority Data

Apr. 28, 2005 (AT) ..... A 729/2005

(51) Int. Cl.
*A47B 96/00* (2006.01)

(52) U.S. Cl. ..... 312/323; 312/110

(58) Field of Classification Search ..... 312/322, 312/323, 325, 326, 327, 331, 294, 109, 110
See application file for complete search history.

(56) References Cited

U.S. PATENT DOCUMENTS

| | | | | |
|---|---|---|---|---|
| 3,221,803 | A * | 12/1965 | Lambert | 160/206 |
| 4,375,907 | A * | 3/1983 | Vander Kooi et al. | 312/109 |
| 4,591,214 | A * | 5/1986 | Reuter et al. | 312/110 |
| 4,600,254 | A * | 7/1986 | Whalen | 312/323 |
| 4,615,570 | A * | 10/1986 | Goodman | 312/110 |
| 4,641,896 | A * | 2/1987 | Iimura et al. | 312/110 |
| 4,923,259 | A * | 5/1990 | Bartok | 312/223.2 |
| 5,026,130 | A * | 6/1991 | Wright et al. | 312/323 |
| 2004/0252045 | A1 | 12/2004 | Wu | |
| 2005/0264144 | A1* | 12/2005 | Verbeek et al. | 312/323 |

FOREIGN PATENT DOCUMENTS

| | | |
|---|---|---|
| DE | 2 102 653 | 8/1972 |
| DE | 2 225 328 | 6/1973 |
| DE | 78 11 011 | 8/1978 |
| DE | 27 52 186 | 6/1979 |

(Continued)

OTHER PUBLICATIONS

International Search Report issued Aug. 10, 2006 in the International (PCT) Application of which the present application is the U.S. National Stage.

*Primary Examiner*—James O Hansen
(74) *Attorney, Agent, or Firm*—Wenderoth, Lind & Ponack, L.L.P.

(57) ABSTRACT

A cupboard-shaped piece of furniture (1) includes side walls (2), on each of which a control mechanism (4) for the displacement of a door leaf (7) is arranged, whereby the control mechanisms (4) are connected by means of a synchronisation rod (10) for the synchronised movement thereof. The synchronisation road (10) includes a fixing device (12) on at least one end region for the detachable connection of the synchronisation rod (10) to a rotating piece (17) of the control mechanism (4), the fixing device (12) being embodied such that the synchronisation rod (10) may also be connected to the rotating piece (17) when the rotating piece (17) is already preassembled on a side wall (2) of the piece of furniture (1).

22 Claims, 10 Drawing Sheets

FOREIGN PATENT DOCUMENTS

| | | |
|---|---|---|
| DE | 28 29 727 | 1/1980 |
| DE | 79 27 158 | 3/1980 |
| DE | 88 00 293 | 5/1988 |
| EP | 0 730 075 | 9/1996 |
| EP | 1 375 806 | 1/2004 |

* cited by examiner 6
9
5'
14
5
17
17'
16
13
15
10'
10
12
11

6
9
5'
5
12
13
14
10
11
4

5'
5
16
15
13
10
B
17
10'
11

6
9
5
A
A
5'
11
14
4

12
A-A
5'
5
B
10
11

CUPBOARD-STYLE FURNITURE ITEM

This application is a continuation of International application PCT/AT2006/000152, filed Apr. 14, 2006.

The invention relates to a cupboard with side walls on each of which a positioning device is arranged for moving a flap, wherein the positioning devices are linked by a synchronisation rod to synchronise their movements and wherein, in the region of at least one of its ends, the synchronisation rod comprises a securing device for releasably connecting the synchronisation rod with a pivotable part of the positioning device.

Furthermore, the invention relates to a method for fitting a synchronisation rod of this type to positioning devices which are attached to opposite sidewalls of a furniture item.

The positioning devices described above are preferably used to move flaps or hinged doors on furniture items, particularly overhead cupboards, from a closed to an open position and vice versa. In the case of heavy flaps and/or flaps with large surface areas, means are known in the art whereby a positioning device of this type is arranged on each vertical sidewall and each positioning device is linked to the other by a synchronising rod running across. On the one hand, this allows the two positioning devices to be adjusted together and, on the other hand, the synchronisation rod provides for a synchronous rotational movement of both positioning devices and, thus, an even movement of the flap.

It is an object of the present invention to propose a synchronisation rod of the type mentioned in the introduction with versatile application.

This is achieved according to the invention by an advantageous embodiment in which the securing device is constructed such that the synchronisation rod can also be linked to the pivotable part when the pivotable part has already been fixed to a sidewall of the furniture item. Constructed according to the invention, the synchronisation rod can be releasably attached to the pivotable part and, if required, removed.

A particular benefit is provided in being able to fit the rod later since the two positioning devices can first be fitted easily with the flap, and, when this is completed, the synchronisation rod can be inserted. This allows slight errors in installation and other installation tolerances to be compensated. A further advantage lies in the fact that, if length of the synchronisation rod is made to adjust, it can be used in furniture items of varying widths where the applicability of the synchronisation rod is considerably extended. As regards logistical aspects, the packaging size is reduced since each part, that is the positioning device and synchronisation rod, can be packed separately.

A preferred embodiment of the invention provides that, in the region of each of its ends, the synchronisation rod comprises securing devices to provide a detachable connection with a pivotable part on each positioning device.

The "pivotable part" of the positioning device can be, for example, the actuating arm for moving the flap or elsewise a separate component or a bearing part whose motion correlates to the movement of the flap during its motion path. In this arrangement, it is irrelevant whether the pivotable part is pre-assembled directly to the sidewall of a furniture item, or indirectly via the positioning devices attachable to the sidewalls, or via a housing component of the positioning devices to the sidewall of the furniture item.

A preferred embodiment of the invention provides that at least one securing device comprises a screw connection. Alternatively, or in addition to this, it can be beneficial if at least one securing device comprises a mechanical latch connection. Then the design can be arranged such that the mechanical latch connection has two latch parts engagable with each other, wherein one latch part can be hung in the other and can be latched onto it by pivoting. This allows the synchronisation rod to be snapped easily to the pivotable part. Optionally, or in addition to this, it can be beneficial if at least one securing device has an interlocking connection to provide a positive lock connection for the synchronisation rod with the positioning device. A practical arrangement of this is if at least one end of the synchronisation rod has a non-circular cross section which can be inserted into a corresponding aperture in the pivotable part of the positioning device.

All lid stays and actuating devices according to the state of art for moving the flap can be used to form the positioning device. A practical embodiment provides that the positioning device comprises an actuating arm which is provided to move the flap. The actuating arm is normally acted upon by a drive device which can take the form of a spring device, for example, whereby the spring device is designed and arranged such that it can support a heavy flap in the open position. It can be beneficial if the actuating arm is attached to a sidewall or a housing so that it can swivel around a first pivoting axis between an open position and a closed position, and which is linked to the flap or to a fitting on the flap so that it will swivel around a second pivoting axis. The design in this respect can be arranged such that the synchronisation rod can be secured to the first pivoting axis of the actuating arm. The scope of the invention can also include, however, that the synchronisation rod, for preference, is secured detachably in the vicinity of a pivoting axis of a control cam known in the art.

A further embodiment of the invention provides that the synchronisation rod in the fitted condition turns with the pivotable part of the positioning device around the same axis. A rigid connection between the positioning device and the synchronisation rod will allow the torque in one positioning device to be transferred directly to the other which will harmonise the opening and closing movements of the flap.

In order to fit the same synchronisation rod to different widths of furniture frames it can be provided that the synchronisation rod comprises at least two parts which are displaceable—preferably telescopically—relative to each other or can attached to each other. The parts can be constructed so that they are acted on by a spring force which forces both parts apart where the synchronisation rod is supported at both ends in the fitted condition and held in place by an expansion force. If the relative length of the synchronisation rod is determined beforehand, it can be beneficial to fix the relative position of the two parts together by a securing arrangement, preferably an eccentric clamp.

An embodiment of the invention provides that the securing device can be covered by a cover part to give the synchronisation rod a pleasing visual appearance. It is preferable if the cover part is located on the synchronisation rod so that it can slide—preferably longitudinally—along the rod. This exposes the securing device to provide access, for example, for a tool. Once manipulation has finished, the cover part can be replaced in the position where it provides complete cover for the securing device.

The method according to the invention for assembling the synchronisation rod, which is provided to ensure synchronised movement of positioning devices to be arranged on two opposing side walls of a furniture item, and whereby at least one positioning device has at least one rotatable part to move the flap, is characterised in that

- the pivotable part is fastened to the sidewall of the furniture item in a first assembly step, and
- the synchronisation rod is secured to the pivotable part in a second assembly step.

BRIEF DESCRIPTION OF THE DRAWINGS

Further benefits and details of the invention will be explained in more detail using the following description of the figures, referring to the following drawings. They show, in.

DETAILED DESCRIPTION OF THE INVENTION

Figure 1:
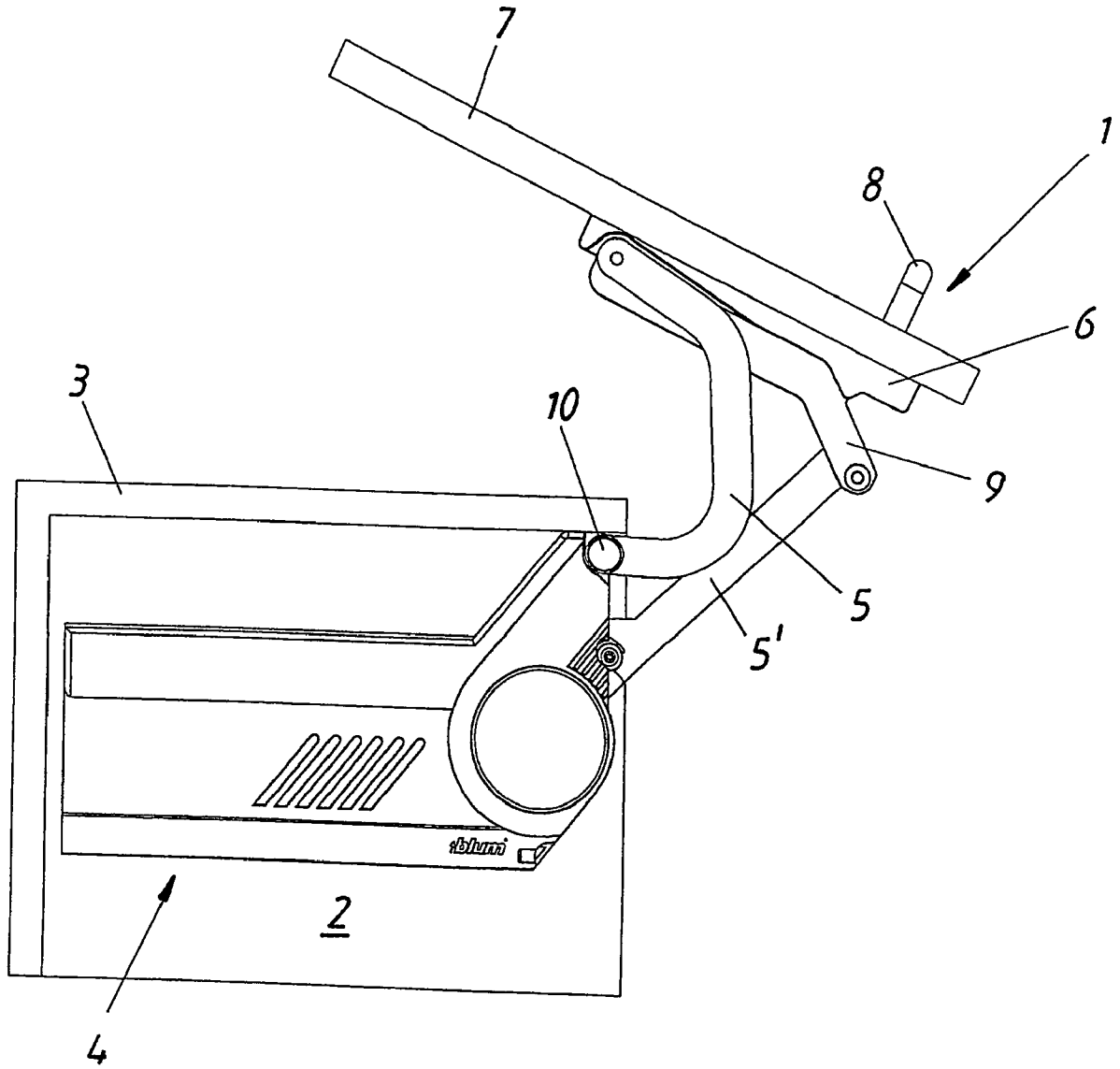
FIG. 1 a side view of an embodiment of a furniture item according to the invention, FIG. 2*a*, 2*b* a perspective view of a positioning device with a synchronisation rod running laterally and an exploded view of the positioning device, FIG. 3 an enlarged detailed view of the pivotable part and the synchronisation rod, FIG. 4*a*-4*c* various views of the positioning device, FIG. 5*a*, 5*b* a plan view of a positioning device and a section through the C-C axis from FIG. 5*a*, FIG. 6 a further embodiment of the invention where the length of the synchronisation rod is adjustable, FIG. 7 the design example from FIG. 6 with secured parts of the synchronisation rod, FIG. 8*a*, 8*b* an example of a possible means of connecting the synchronisation rod with a pre-fitted positioning device by means of a mechanical latch connection, FIG. 9*a*, 9*b* an alternative possible means of connecting the synchronisation rod with a pre-fitted positioning device by means of a screw connection, FIG. 10 a perspective view of a cupboard with pre-fitted positioning devices and a synchronisation rod detachably connected to them.

FIG. 1 shows in a side view a cupboard 1 having a sidewall 2 and a cupboard top 3. The upper region of the sidewall 2 has, fixed to it, a positioning device 4 hinged to the fitting 6 on the flap 7 by means of two pivoting actuating arms 5 and 5'. A flap 7, opening upwards, with a handle 8, is fastened to the fitting 6 and secured in the design example shown so that it swings up and over the furniture body towards the rear. In order to move flaps having a large surface area and/or heavy weight it is provided that on both opposing sidewalls 2 of the item of furniture 1 there are such positioning devices 4 attached, wherein the positioning devices 4 are linked by a synchronisation rod 10 to ensure synchronised movement of both positioning devices 4. In the figure shown only the cross section of the synchronisation rod 10 is visible, more details of which will be shown in the following drawings.

Figures 2A, 2B:
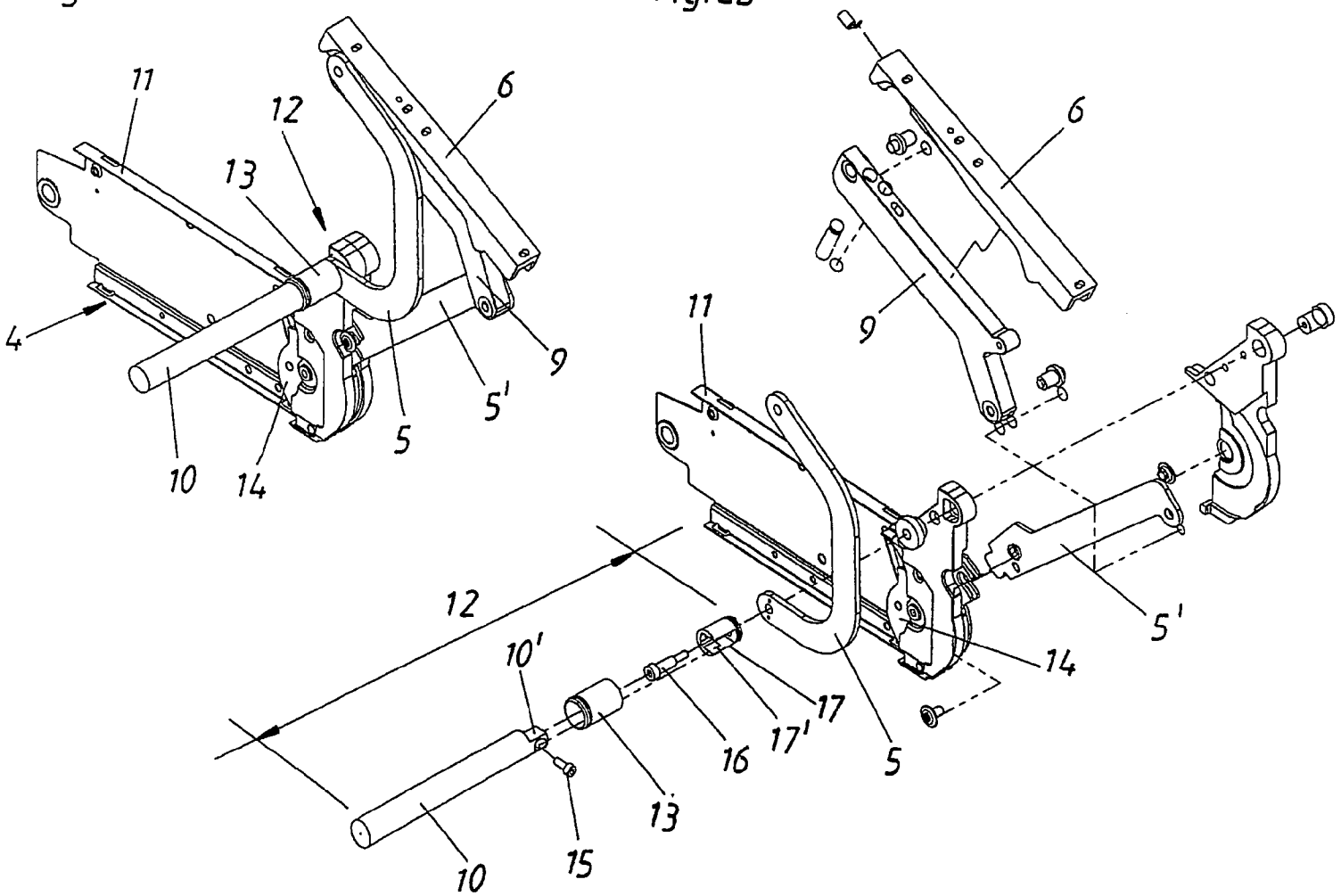

FIG. 2*a* shows a perspective view of a positioning device 4, while FIG. 2*b* gives an exploded view of this design example according to the invention. The positioning device 4 comprises a base plate or housing 11 in which a drive device (not shown), such as a spring device, is incorporated to act on the actuating arms 5 and 5'. A control cam 14 is pivotably mounted with respect to the housing 11 which moves the flap 7 attached to the fitting 6 via both actuating arms 5, 5' and the intermediate lever 9. In order to synchronise the rotational movement with a further positioning device 4, a synchronisation rod 10 is provided which is fixed in a torque proof manner to the positioning arms 5 via a releasable securing device 12. In FIG. 2*b*, a cover piece 13 which can slide axially along the synchronisation rod 10 is covering the securing device 12. It can be seen in FIG. 2*b* that a pivotable part 17 is attached by means of a screw 16. The pivotable part 17 is cup-shaped and has a recess 17' on its outer surface into which the non-circular cross section 10' of the synchronisation rod 10 can be inserted. The non-circular cross section 10' is pierced by a hole, running at right angles to the axial direction, which will take a screw 15 which is screwed into the pivotable part 17. Finally, the cover part 13, in the shape of a tubular sleeve, is pushed over the securing device 12.

Figure 3:
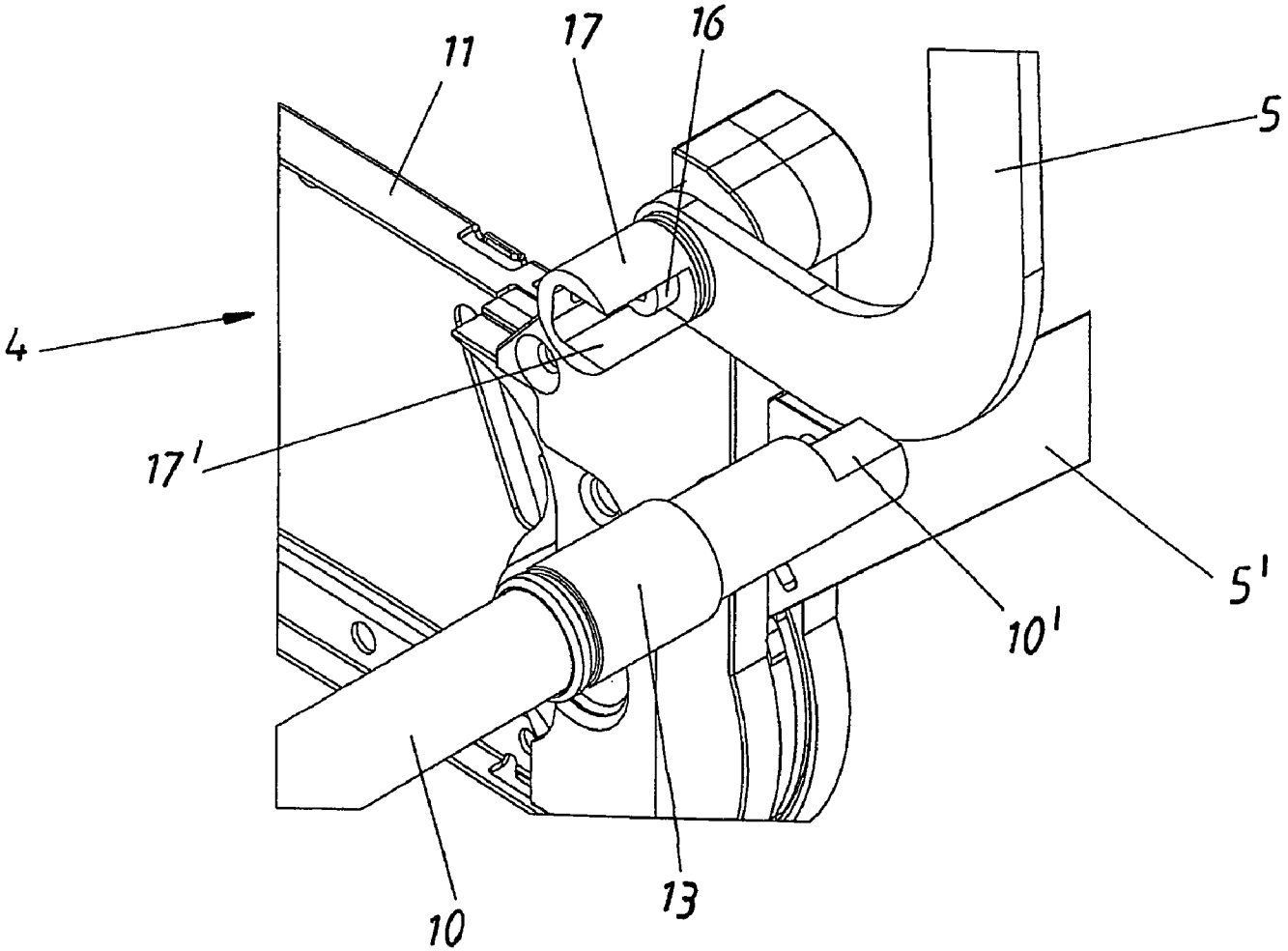

FIG. 3 shows an enlarged view of a detail of the positioning device 4. The pivotable part 17 is screwed to the actuating arm 5 by the screw 16. The non-circular section 10' of the synchronisation rod 10 is inserted in the aperture 17' whereby, in this figure, the synchronisation rod 10 is preferably held by this twist lock connection. To prevent the synchronisation rod 10 from falling out of the pivotable part 17, the tubular cover part 13 is provided which is pushed over the pivotable part 17.

Figures 4A, 4B, 4C:
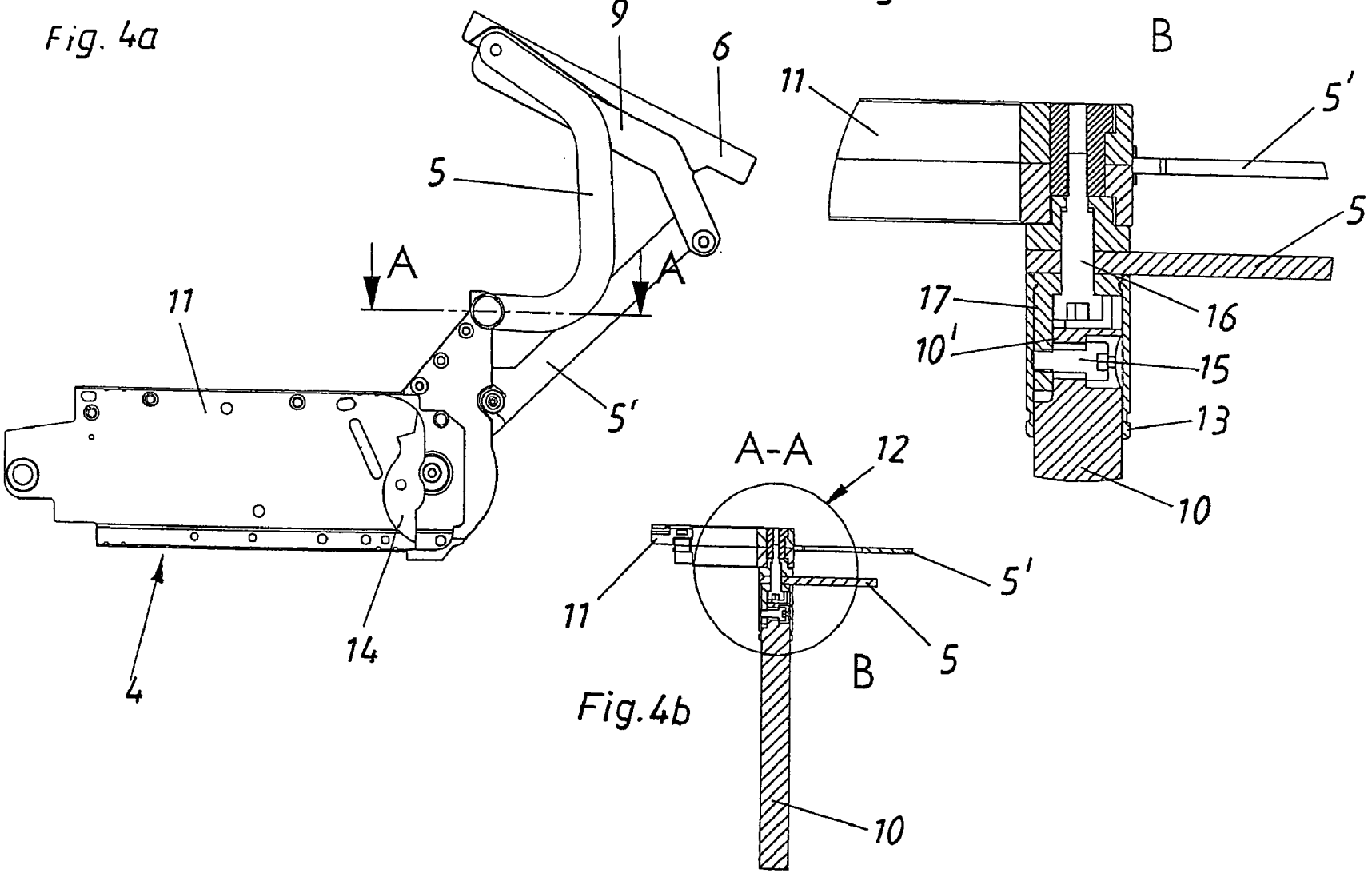

FIGS. 4*a* to 4*c* show the positioning device 4 in various aspects. FIG. 4*a* provides a side view of the positioning device 4 as described already in FIGS. 2*a* and 2*b*. FIG. 4*b* shows a cross section taken along the A-A axis in FIG. 4*a*. FIG. 4*c* shows the enlarged detail B from FIG. 4*b*. According to FIG. 4*c*, the pivotable part 17 is secured by screw 16 to the actuating arm 5 being movable with respect to the housing 11. The tapered cross section 10' of the synchronisation rod 10 is secured by a screw 15, running perpendicularly to the pivotable part 17. The tubular cover part 13 is then pushed over the securing device 12.

Figure 5A:
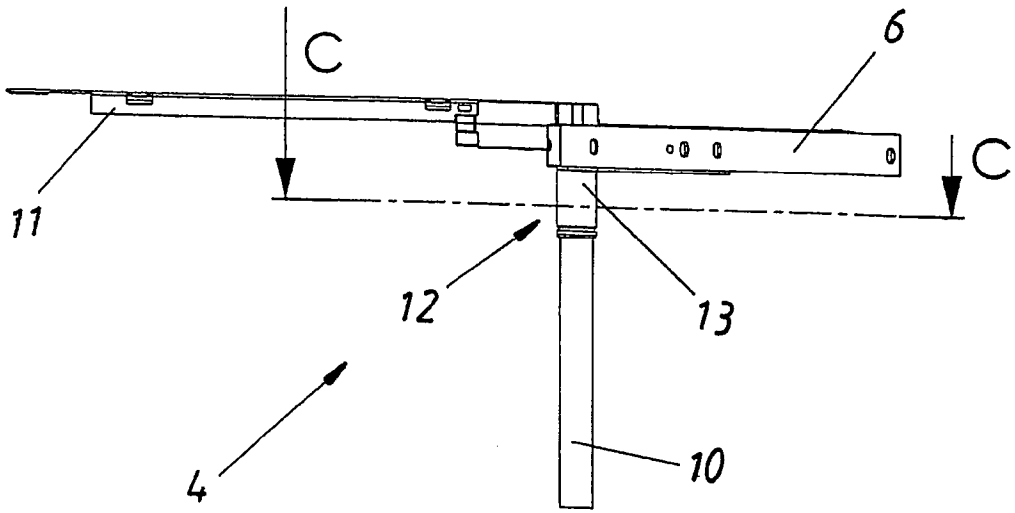
Figure 5B:
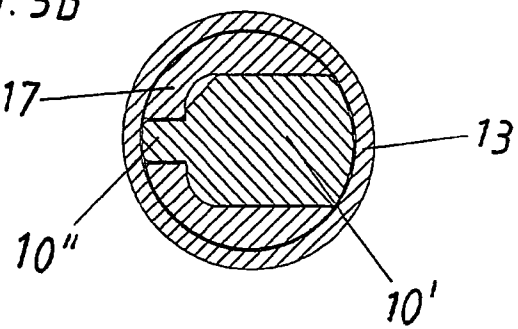

FIG. 5*a* shows a plan view of the positioning device 4 with a housing 11 and the fitting 6 of the flap viewed from above. FIG. 5*b* shows a section through the line C-C in FIG. 5*a*. The non-circular section 10' on the synchronisation rod 10 has a projection 10" which fits into a mating recess in the pivotable part 17, locking both together in rotation. Since both parts are fixed rotationally in relation to each other, in the assembled condition the synchronisation rod 10 rotates together with the pivotable part 17 of the positioning device around the same axis.

Figure 6:
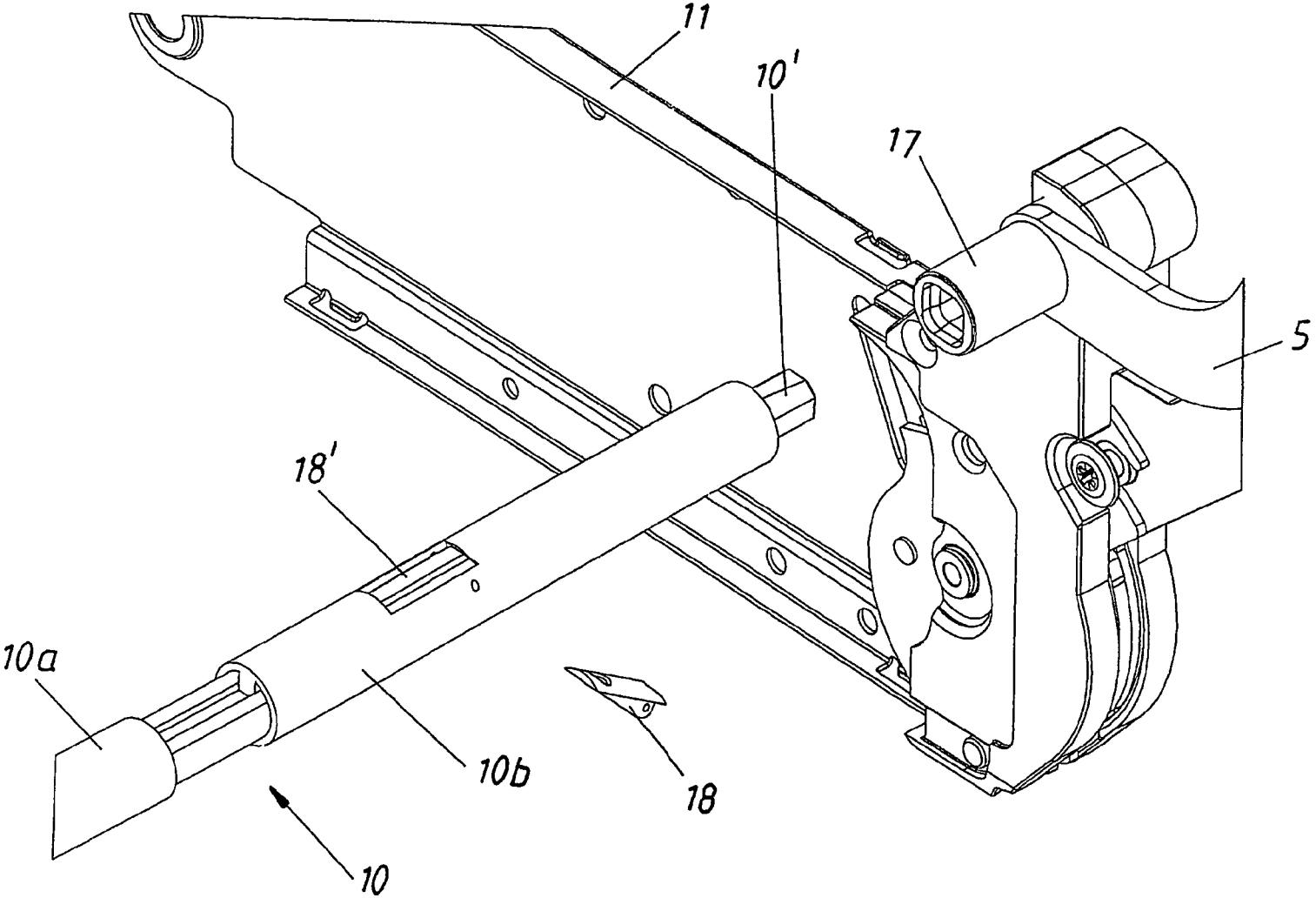

FIG. 6 shows another embodiment of the invention with a synchronisation rod 10 adjustable lengthwise. The synchronisation rod 10 comprises two parts 10*a* and 10*b* constructed so that they can be displaced relative to each other. Thus the synchronisation rod 10 can be made to fit into a frame of any width for furniture item 1. If the length is adjusted to link the two positioning devices 4, the relative position of the two parts 10*a* and 10*b* can be secured using the securing arrangement 18 which comprises an eccentric catch. The eccentric catch is inserted into the recess 18', thereby locking both parts 10*a* and 10*b*. The pivotable part 17 has a device (not shown)—such as an elongated hole—allowing a certain amount of radial and longitudinal movement in relation to the positioning device 4 and, respectively, the actuating arm 5 to compensate for small errors in assembly and dimensional tolerances.

Figure 7:
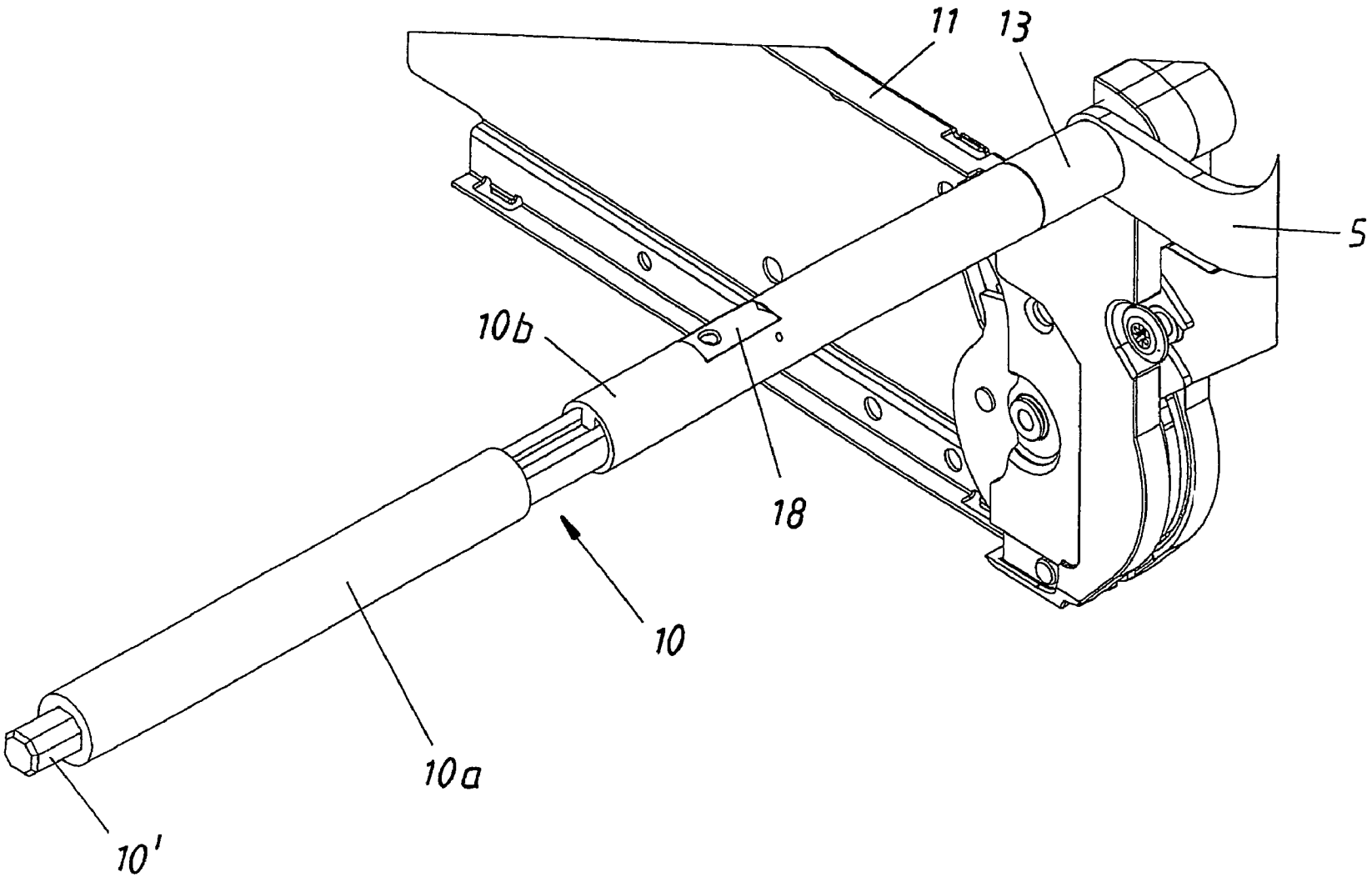

FIG. 7 shows an embodiment of the invention whereby both ends of the synchronisation rod 10 can have a non-circular cross section 10'—in the case shown, a polygonal shape—which is part of a securing device 12. The end section of the polygonal end 10' can be slightly tapered so that there is essentially no play when inserted into the pivotable part 17. Furthermore, it can be seen that the eccentric catch 18 is inserted into the part 10*a* of the synchronisation rod 10 and the relative position of both parts 10*a* and 10*b* is thus fixed. For visual considerations, a tubular sleeve part 13 is slid over the securing device 12 at both end sections.

Figure 8A:
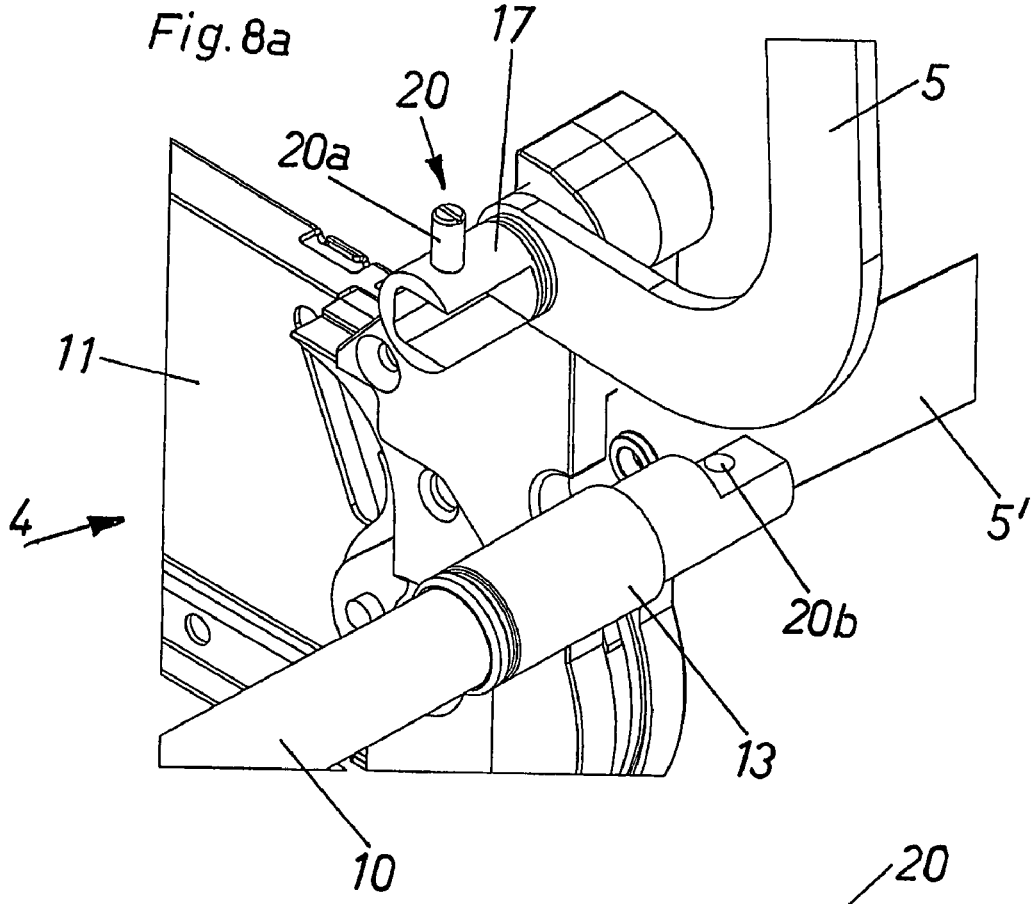
Figure 8B:
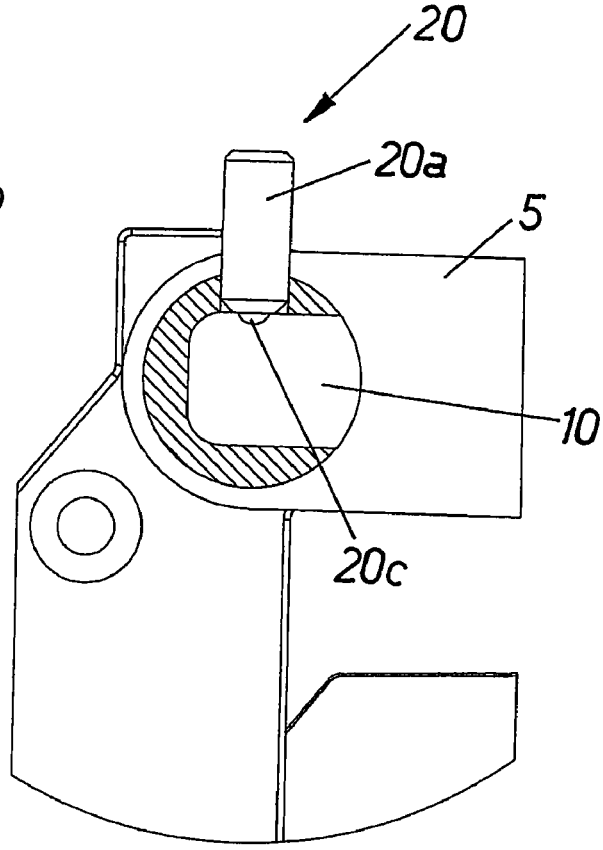

FIG. 8*a* shows an example of a detachable connection for the synchronisation rod 10 which would require no tooling and comprises a mechanical latch connection 20 incorporated in the pivotable part 17 which is arranged on or formed in the actuating arm 5. FIG. 8*b* shows a vertical section through the rotatable part 17 with the latched synchronisation rod 10 from FIG. 8*a*. In a first assembly step, a positioning device 4 is assembled to each of two opposing sidewalls 2 of a furniture item 1. The synchronisation rod 10, preferably adjustable, is then slid into or on to the pivotable part 17 at right angles to the axis of rotation of the pivotable part 17, hence from the front. The mechanical latch connection 20 comprises a pin 20*a* screwed at least partly into the pivotable part 17, where a ball 20*c*, preferably spring-loaded, is arranged on the underside of the pin 20*a*, and the ball 20*c* can be forced into a recess 20*b* provided in the synchronisation rod 10, thus latching the synchronisation rod 10 with the pivotable part 17 of the positioning device 4. According to a design example of the invention, provision is made that, in the assembled condition, the longitudinal axis of the synchronisation rod 10 is essentially in line with the axis of rotation of the pivotable part 17. It is easy for the user to remove the synchronisation rod 10 by simply withdrawing it towards the user standing in front of the furniture item.

Figure 9A:
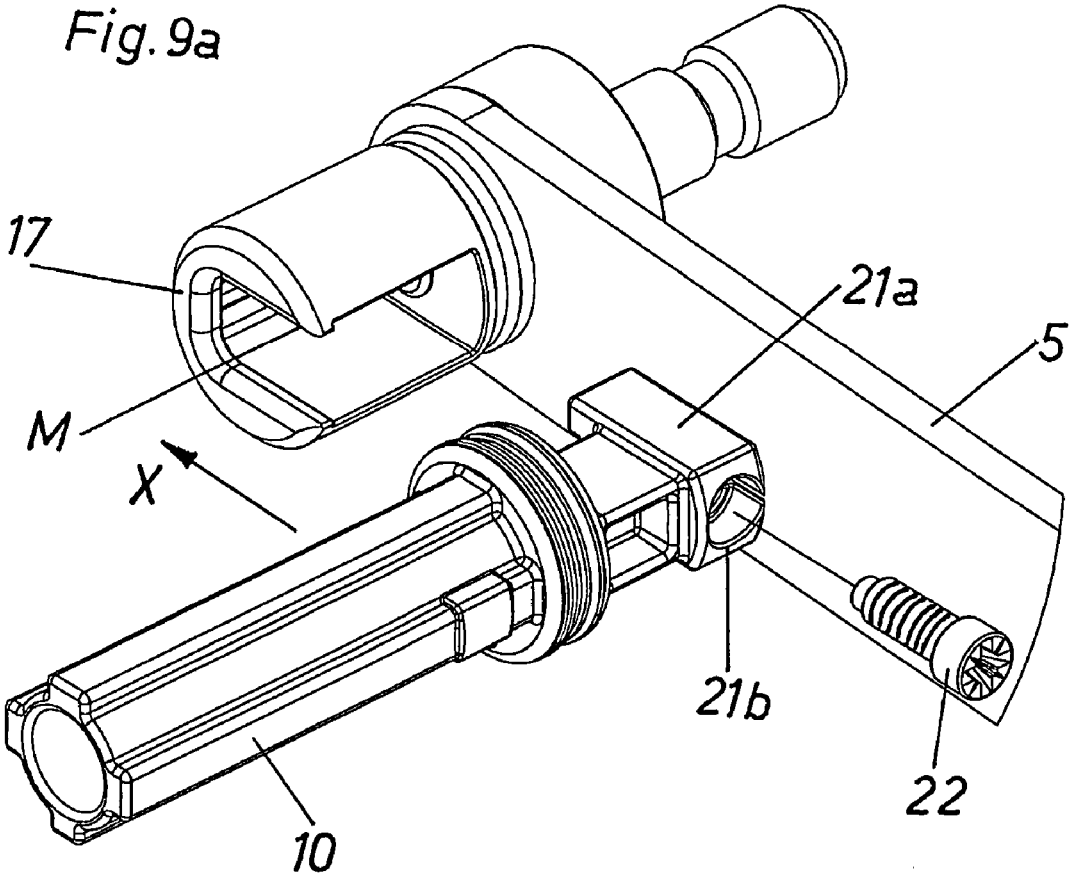
Figure 9B:
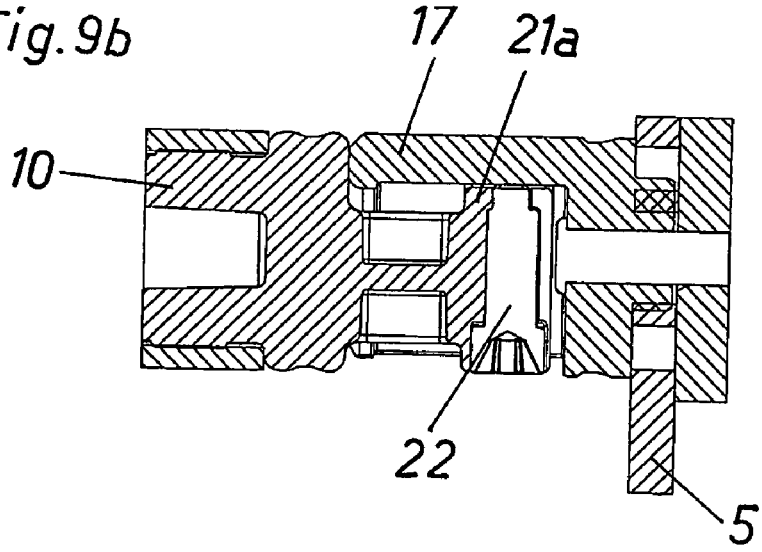

FIGS. 9*a* and 9*b* show a further example of a detachable arrangement between the synchronisation rod 10 and the pivotable part 17 of the actuating arm 5. A screw 22 is provided, shown in the illustration, which, when screwed in, and with the synchronisation rod 10 in the installed condition, forces the two clamping jaws 21*a* and 21*b* radially apart inside the pivotable part 17 thus creating a force fit between the synchronisation rod 10 and the pivotable part 17. Attention is drawn also to the rotational axis M of the pivotable part 17, or, respectively, that of the actuating arm 5, whereby the synchronisation rod 10 can be slid in and out of the pivotable part 17 perpendicular to the rotational axis M, that is, in the direction of the arrow X. This makes for simple assembly of the synchronisation rod 10 after the positioning device 4 or the actuating arm 5 has already been mounted. FIG. 9*b* shows a horizontal section through the arrangement shown in FIG. 9*a* with the synchronisation rod 10 installed.

Figure 10:
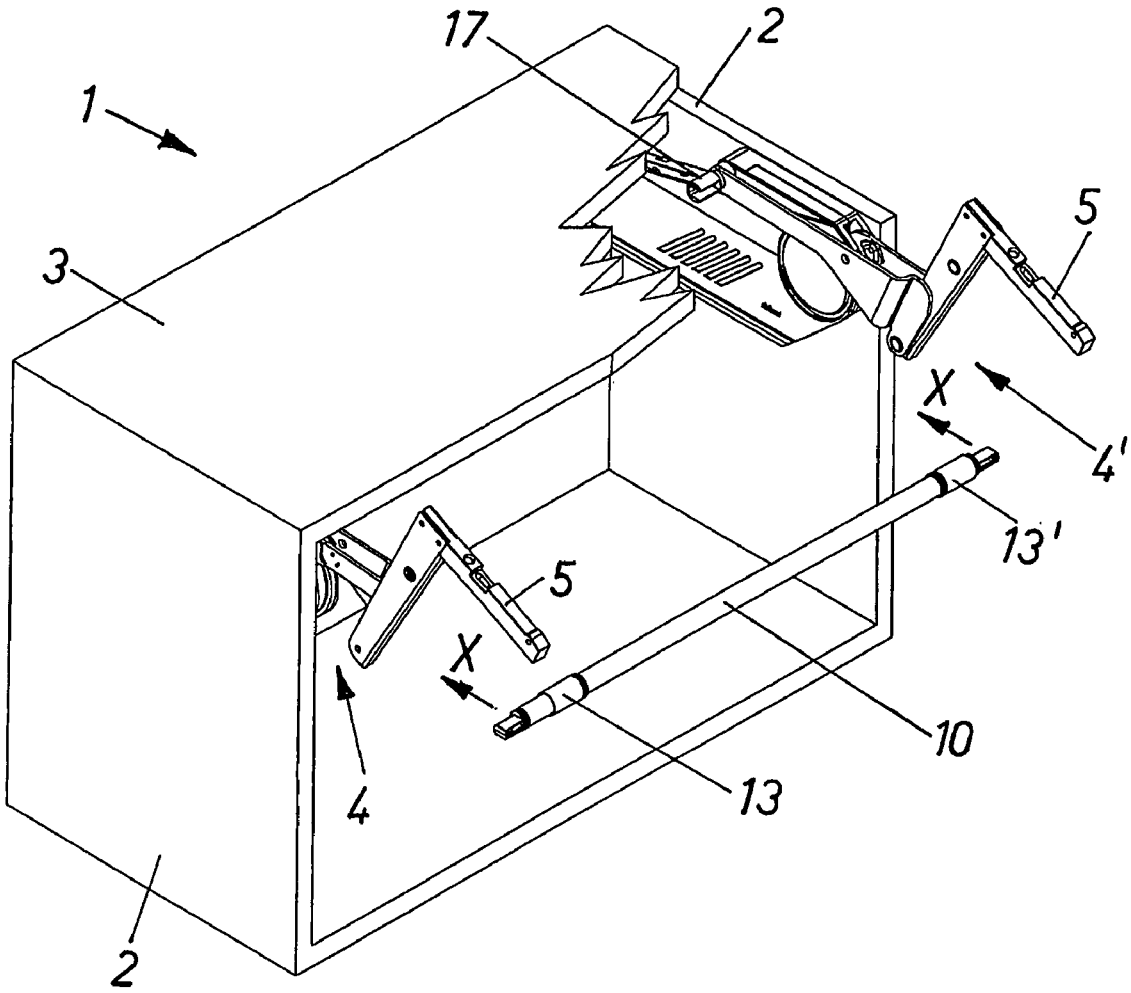

FIG. 10 shows a perspective illustration of a cupboard 1 whereby a positioning device 4 and 4' is provided on each of two opposing sidewalls 2 to move a flap 7 (FIG. 1), not shown for reasons of clarity. The flap 7, as shown, opens upwards and is in a vertical position when closed. Synchronisation of the two positioning devices 4 and 4' to provide stable movement of the flap 7 is provided by a synchronisation rod 10 which is detachably linked, at least at one, end—preferably at both ends—with pre-fitted pivotable parts 17. A portion of the top of the cupboard 3 is cut away to obtain a better view. The synchronisation rod 10 is easy to move perpendicular to the rotational axis of the pre-fitted pivotable part 17, that is, in the direction of both arrows designated by X, in and out of the pivotable part 17 of each of the positioning devices 4 and 4', and, preferably, can be latched and/or screwed together.

The invention is not restricted to the illustrated embodiments, but rather includes or extends to all alternatives and technical equivalents which fall within the scope of the following claims. Also, the positional terminology chosen in the description, such as over, under, relate to the usual installation location of the positioning device 4, or to the specific drawing described or illustrated, and, if the position should change, such references are to be read across in the same sense to the new position. The type of connection between the synchronisation rod 10 and the pivotable part 17 can be achieved by means familiar to a person skilled in the art, such as through various forms of latch and/or screwed connections.

The invention claimed is:

1. A cupboard comprising:

two sidewalls; and two positioning devices fixed to said sidewalls, respectively, said positioning devices being arranged to move a flap;

said positioning devices being linked by a synchronization rod so as to synchronize movements of said positioning devices, wherein a first one of said positioning devices comprises an actuating arm arranged to move said flap, an end of said actuating arm being attached to one of said sidewalls or to a housing so as to be pivotable about a first pivoting axis between an open position and a closed position, another end of said actuating arm being linked to said flap or to a fitting on said flap, wherein said first one of said positioning devices includes a pivotable part connected to said actuating arm so as to be pivotable together with said actuating arm relative to said one of said sidewalls or said housing about the first pivoting axis, wherein said synchronization rod comprises a first securing device in a region of a first end of said synchronization rod, said first securing device being arranged so as to releasably connect said synchronization rod with said pivotable part such that said synchronization rod is turnable together with said pivotable part of said first one of said positioning devices about the first pivoting axis.

2. The cupboard according claim 1, wherein a second one of said positioning devices includes a pivotable part pivotably connected to said second one of said positioning devices at a fixed point relative to said second one of said positioning devices so as to be pivotable relative to said second one of said positioning devices about the fixed point, and wherein said synchronization rod comprises a second securing device arranged in a region of a second end of said synchronization rod, said second securing device being arranged to releasably connect said synchronization rod to said pivotable part of said second one of said positioning devices.

3. The cupboard according to claim 1, wherein said synchronization rod as arranged to be connectable to or removable from said pivotable part of said first one of said positioning devices without the use of tools.

4. The cupboard according claim 1, wherein said synchronization rod is connectable to said pivotable part perpendicularly to the first pivoting axis.

5. The cupboard according to claim 4, wherein said synchronization rod is slidably connectable to and slidably removable from said pivotable part.

6. The cupboard according to claim 1, wherein said first securing device is connectable with said pivotable part such that a longitudinal axis of said synchronization rod is essentially in line with the first pivoting axis.

7. The cupboard according to claim 1, wherein said first securing device comprises a screw connection.

8. The cupboard according to claim 1, wherein said first securing device comprises a mechanical latch connection.

9. The cupboard according to claim 8, wherein said mechanical latch connection comprises a resilient or a spring-loaded latch part which is connectable to a mating latch part.

10. The cupboard according to claim 8, wherein said mechanical latch connection comprises two latch parts being connectable with each other, wherein one of said latch parts can be hung in the other and being latchable onto it by pivoting.

11. The cupboard according claim 1, wherein said first securing device comprises an interlocking connection so as to provide a twist lock connection of said synchronization rod with said first one of said positioning devices.

12. The cupboard according to claim 11, wherein said first end of said synchronization rod has a non-circular cross section which can be inserted into a corresponding aperture in said pivotable part of said first one of said positioning devices.

13. The cupboard according to claim 1, wherein said actuating arm is linked to said flap or to a fitting on said flap so that said actuating arm can swivel around a second pivoting axis.

14. The cupboard according to claim 1, wherein said synchronization rod comprises at least two parts arranged to be telescopically displaceable relative to each other and fixable relative to one another.

15. The cupboard according to claim 14, wherein said at least two parts are arranged so as to be acted on by a spring force which forces both parts apart.

16. The cupboard according to claim 14, wherein a relative position of said at least two parts to one another can be fixed by a securing arrangement.

17. The cupboard according to claim 1, wherein said first securing device is arranged to be covered by a cover part.

18. The cupboard according to claim 17, wherein said cover part arranged on said synchronization rod so as to be slideable along said synchronization rod.

19. The cupboard according to claim 1, wherein said pivotable part includes an opening, and wherein said first securing device includes two clamping jaws, said clamping jaws being movable apart from each other in a radial direction of said synchronization rod so as to press-fit said first end of said synchronization rod in said opening of said pivotable part.

20. The cupboard according to claim 1, wherein said pivotable part includes a spring-loaded ball arranged to releasably latch said first end of said synchronization rod.

21. A method for assembling a synchronization rod, which is provided to ensure synchronized movement of two positioning devices respectively arranged on two opposing sidewalls of a furniture item so as to move a flap, said method comprising:

connecting a pivotable part to an actuating arm of a first one of the positioning devices so as to be pivotable together with the actuating arm relative to the first one of the positioning devices about a first pivoting axis, wherein an end of the actuating arm is attached to one of the sidewalls or to a housing so as to be pivotable about the first pivoting axis between an open position and a closed position, and wherein another end of the actuating arm is linked to the flap or to a fitting on the flap; and securing a synchronization rod to the pivotable part of the first one of the positioning devices, wherein the synchronization rod comprises a first securing device in a region of a first end of the synchronization rod, and the first securing device being arranged so as to releasably connect the synchronization rod with the pivotable part such that the synchronization rod is turnable together with the pivotable part about the first pivoting axis.

22. A cupboard comprising:

two sidewalls; and two positioning devices fixed to said sidewalls, respectively, said positioning devices being arranged to move a flap;

said positioning devices being linked by a synchronization rod so as to synchronize movements of said positioning devices, wherein a first one of said positioning devices comprises a first actuating arm arranged to move said flap, said first actuating arm being attached to one of said sidewalls or to a housing so as to be pivotable about a first pivoting axis between an open position and a closed position, said first actuating arm being linked to said flap or to a fitting on said flap, wherein said first one of said positioning devices includes a first pivotable part connected to said first actuating arm so as to be pivotable together with said first actuating arm relative to said one of said side walls or to said housing about the first pivoting axis, wherein a second one of said positioning devices comprises a second actuating arm arranged to move said flap, said second actuating arm being attached to one of said sidewalls or to a housing so as to be pivotable about the first pivoting axis between the open position and the closed position, said second actuating arm being linked to said flap or to a fitting on said flap, wherein said second one of said positioning devices includes a second pivotable part connected to said second actuating arm so as to be pivotable together with said second actuating arm relative to said one of said walls or to said housing about the first pivoting axis, and wherein said first and second pivotable parts each include an opening arranged to face an opening of said cupboard, said openings of said first and second pivotable parts being parallel to each other, said synchronization rod being connectable with said first and second pivotable parts by inserting said synchronization rod into said opening of said cupboard such that ends of said synchronization rod fit into said openings of said first and second pivotable parts, respectively, wherein the synchronization rod comprises a first securing device in a region of a first end of the synchronization rod, and the first securing device being arranged so as to releasably connect the synchronization rod with the first pivotable part such that said synchronization rod is turnable together with said first and second pivotable parts about the first pivoting axis.

* * * * *